United States Patent [19]

Stonor et al.

[11] Patent Number: 4,720,210

[45] Date of Patent: Jan. 19, 1988

[54] APPARATUS FOR GENERATING WAVES

[76] Inventors: William F. Stonor, 68 Elmfield Road, Gosforth, Newcastle upon Tyne, NE3 4XA; Neil F. Taylor, The Grange, 7 North Road, Ponteland, Newcastle upon Tyne, NE20 9UH; David J. Whittingham, 15 Rookery Close, Mottram Rise, Stalybridge, Cheshire; Alan R. Hough, 3 Mark Wood, Delph, Oldham, Lancashire, all of England

[21] Appl. No.: 13,531

[22] Filed: Feb. 11, 1987

[30] Foreign Application Priority Data

Feb. 17, 1986 [GB] United Kingdom ..... 8603895

[51] Int. Cl.[4] ..... A47K 3/10

[52] U.S. Cl. ..... 405/79; 4/491

[58] Field of Search ..... 405/79; 4/491

[56] References Cited

U.S. PATENT DOCUMENTS

| | | | |
|---|---|---|---|
| 3,473,334 | 10/1969 | Dexter | 405/79 |
| 4,522,535 | 6/1985 | Bastenhof | 405/79 |
| 4,539,719 | 9/1985 | Schuster | 405/79 X |

*Primary Examiner*—Randolph A. Reese
*Assistant Examiner*—John Ricci
*Attorney, Agent, or Firm*—Hopgood, Calimafde, Kalil, Blaustein & Judlowe

[57] ABSTRACT

Apparatus for generating waves in a swimming pool comprises a reservoir, independent of and separate from the pool, the reservoir containing a volume of water to be supplied to one or more inlets communicating into the lower regions of the swimming pool, and one or more flow paths through which the water from the reservoir is fed to the or each inlet, the or each flow path including a flow control valve therein and a volume of air downstream of the associated control valve for entrainment with the water flowing to the swimming pool such that, on entry of the water into the swimming pool, a wave having a turbulent, air-containing wake is formed.

6 Claims, 3 Drawing Figures

APPARATUS FOR GENERATING WAVES

BACKGROUND OF THE INVENTION

This invention relates to apparatus for generating waves in swimming pools.

Artificial wave generating apparatus for producing either conventional waves or surfing waves are well established, and they operate in accordance with various known techniques.

For example, the water source for creating the wave may be subjected to a controlled combustion process to displace forcibly a controlled volume of said water into the swimming pool to produce a desired wave configuration.

Alternatively water may be provided in a reservoir built at the end of a pool where the water level in the reservoir is above the quiescent level of water in the swimming pool, said water being released to flow under gravity into the lower regions of the pool, the volume and potential energy of the stored water being added to that of the pool and generating the desired wave.

Now that such apparatus is well established and accepted, the public are becoming somewhat bored with the conventional output of the apparatus, typically solitary conventional waves or solitary surf waves.

SUMMARY OF THE INVENTION

It is an object of the invention to provide apparatus capable of generating in a short period of time waves of a variety of frequencies and sizes, said waves having a visual appearance closely resembling natural waves.

According to the present invention there is provided apparatus for generating waves in a swimming pool, the apparatus comprising a reservoir, independent of and separate from the pool, containing a volume of water to be supplied to one or more inlets communicating into the lower regions of the swimming pool, and one or more flow paths through which the water from the reservoir is fed to said inlet or inlets, the or each flow path including therein a flow control valve, a volume of air being provided in the or each flow path downstream of the associated control valve for entrainment with the water flowing to the swimming pool such that, on entry of the water into the swimming pool, a wave having a turbulent, air-containing wake is formed.

In a preferred apparatus, the or each control valve is of the drum type and is conveniently pneumatically operated.

In one embodiment of the invention the bottom of the reservoir is located above the quiescent water level in the swimming pool, water in the reservoir flowing under gravity from the reservoir into the swimming pool, the or each flow path containing a volume of air therein immediately downstream of the or each control valve. This can be compared with existing systems in which the bottom of the reservoir is at the same level as the bottom of the swimming pool itself.

In a further embodiment of the invention, the reservoir is located above, but substantially adjacent the quiescent level of the water in the swimming pool, flow of water from the reservoir to the swimming pool being under the influence of a source of compressed gas applied to the surface of the volume of water within the reservoir, the or each flow path containing a volume of air therein immediately downstream of the or each control valve.

In a still further embodiment of the invention, the reservoir is located below the quiescent level of water in the swimming pool, flow of water from the reservoir to the swimming pool being under the control of a source of compressed gas applied to the surface of the volume of water within the reservoir, air being introduced into the or each flow path downstream of the associated control valve.

In such an embodiment, a vent line extends from a point downstream of the control valve of the or each flow path to a point above the quiescent level of water in the swimming pool, air being drawn into the or each flow path as water flows therethrough.

It will be appreciated that, in all the above-mentioned embodiments, flow of water to the swimming pool is under the control of one or more valves which can be operated as and when desired to release some or all of the water in the reservoir at predetermined time intervals to produce waves of a variety of frequencies and sizes, all said waves having a distinctive visual appearance in that they each comprise a solitary wave front followed by a relatively extensive turbulent wake.

DESCRIPTION OF THE PREFERRED EMBODIMENTS

Figure 1:
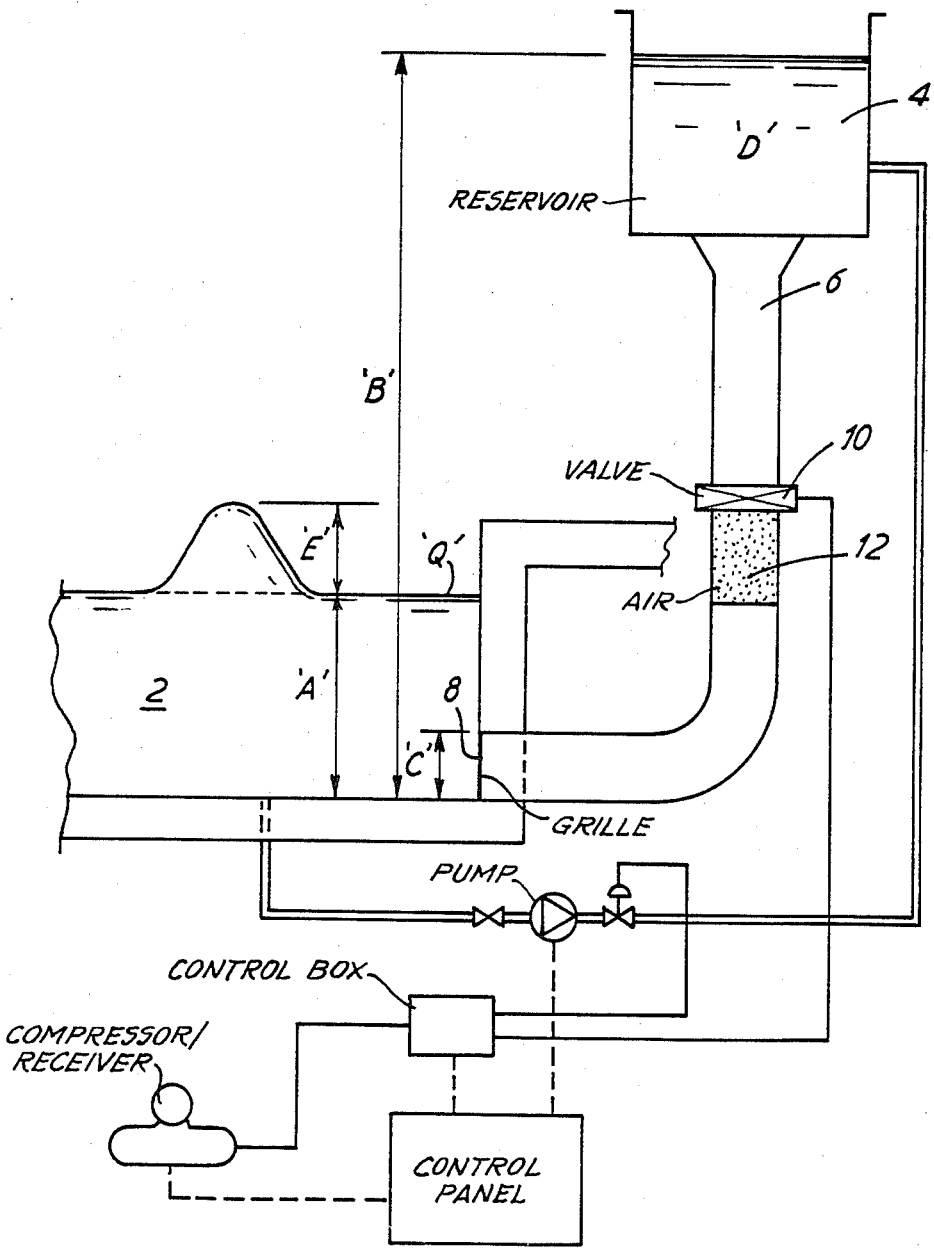
FIGS. 1, 2 and 3 show general arrangements of three different wave-generating apparatus according to the invention.

Referring to FIG. 1, a swimming pool is indicated generally at 2, the quiescent level of water in the pool being referenced 'Q'. The illustrated apparatus comprises a reservoir 4 located at a position substantially above the pool 2, one or more water flow paths or funnels 6 feeding from the reservoir 4 to inlets provided at the lower regions of the pool, said inlets extending the width of the pool and being covered by grilles 8.

The or each funnel 6 includes a pneumatically-operated drum valve 10 for controlling the flow of water from the reservoir 4 to the pool, a volume of air 12 being entrapped in the funnel 6 immediately downstream of the valve 10.

The described apparatus operates as follows. On opening of the or each valve 10, water from the reservoir 4 flows under gravity along the or each funnel 6 and, after passing through the control valve 10, entrains with it the air 12. As the water and entrained air enter the pool by way of the grilles 8, a solitary wave front is formed initially followed by an extremely turbulent wake. Unlike most known arrangements, the resultant wave is formed without the necessity for deflectors or the like in the bottom of the pool, relying purely upon kinetic energy and flow under gravity of water from the reservoir. The artificial wave so formed has a distinctive visual appearance in view of its turbulent nature and, because of the air entrained therein, closely resembles natural waves rolling onto seaside beaches.

The frequency and size of the waves can be varied over a wide range of values by appropriate actuation of the control valves 10, said valves being operable to permit flow of varying quantities of water from the reservoir at given time intervals to create, for example, a series of consecutive waves of the same or different heights.

The depth of water 'A' in the swimming pool 2, the head of water 'B' in the reservoir 4, the inlet opening 'C' and the volume of water 'D' in the reservoir 4 determine the height 'E' of the waves formed, typical systems being capable of producing single or multiple waves at heights varying from 300 mm to in excess of 2 meters, the turbulent wakes of the waves being up to 6 meters in length.

The reservoir 4 is refilled by drawing water direct from the pool 2, which pool can be any one of a variety of different shapes. Specific variations in wave configuration can be achieved by careful structural design of the pool topography and shape.

The control valves 10 are either of generally rectangular or circular shape to conform in configuration with the cross-section of the extent of the flow path between the valves 10 and the inlets to the pool 2.

Figure 2:
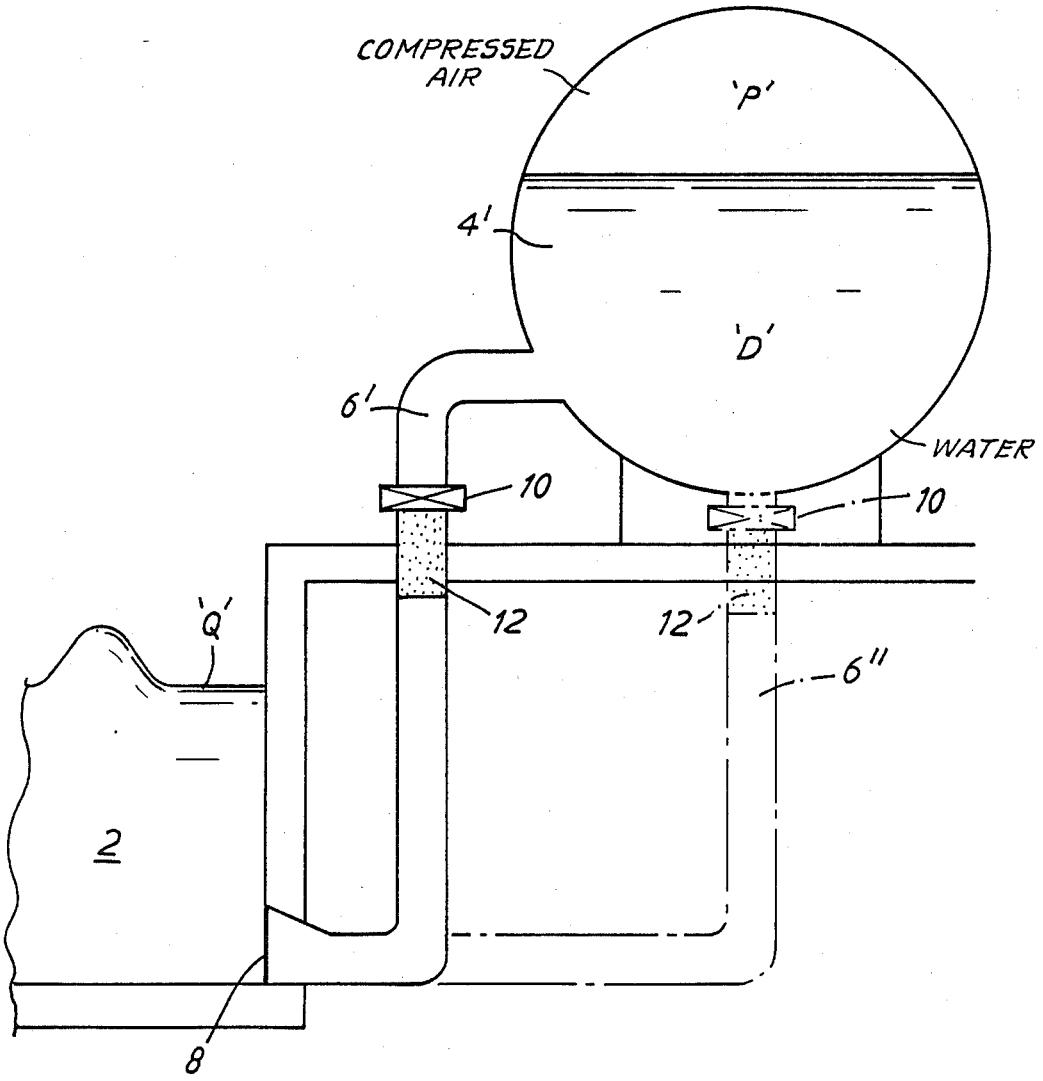

In certain situations, there may not be sufficient space, or it may be visually unacceptable, to provide a reservoir such as 4 at sufficient height above the pool 2 to create the desired head of water 'B'. FIG. 2 illustrates one alternative arrangement which obviates the necessity for the reservoir 4 to be so high up. More particularly, the reservoir 4' is located at or adjacent the side of the pool 2 just above the quiescent level 'Q' of water in the pool. The reservoir 4' comprises a sealed pressure vessel housing a volume of water 'D' and having one or more funnels 6' or 6'' feeding therefrom to the pool 2 in the manner of the apparatus of FIG. 1, each funnel including a valve 10 and a volume of air 12.

The water in the vessel 4' is held under a set, maintained pressure by means of an injection of compressed air 'P' supplied from a compressor (not shown) whereby, on opening of the valve or valves 10, the water in the reservoir 4 is forced into the pool 2 by means of the compressed air and enters the lower regions of the pool through the grilles 8 to form waves as described with reference to the apparatus of FIG. 1. The height of the waves so formed can be varied by, amongst other things, alteration of the pressure applied to the water in the reservoir 4' while, as with the apparatus of FIG. 1, the number and frequency of the waves can be controlled by appropriate actuation of the valves 10. The pressure vessel is refilled by pumping water direct from the pool into the vessel.

Figure 3:
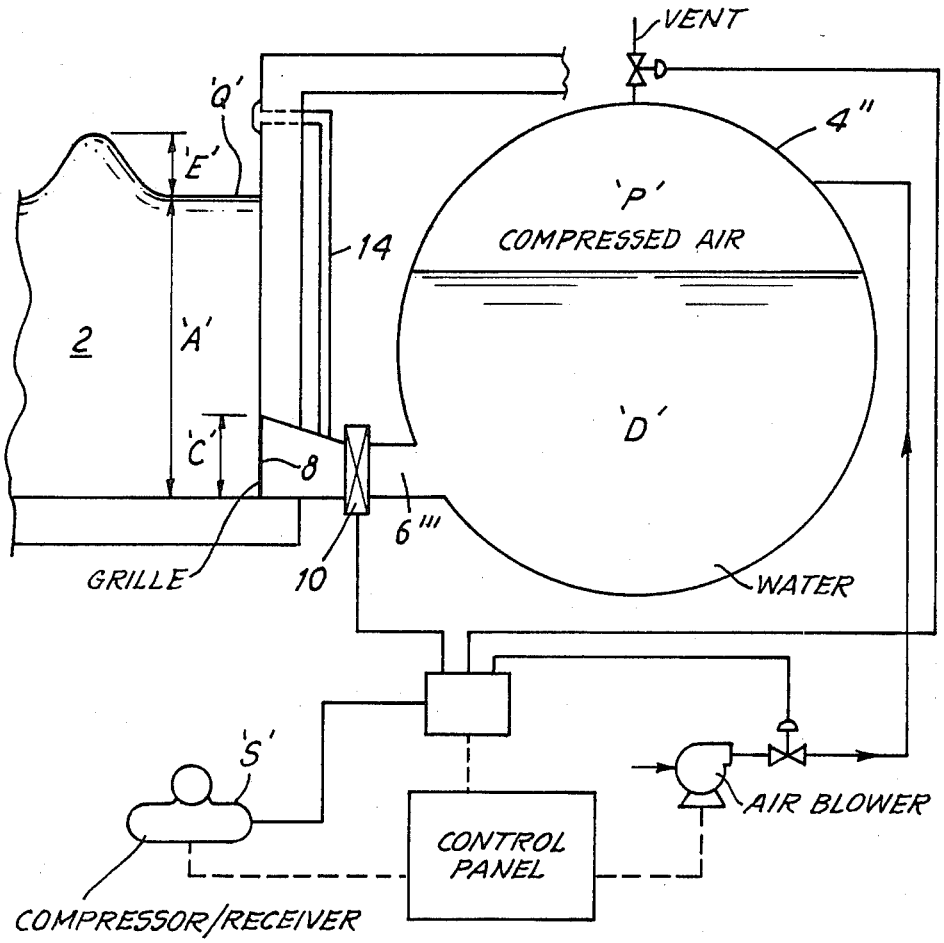

An even more compact apparatus according to the invention is shown in FIG. 3 in which the reservoir comprises a pressure vessel 4'' located substantially below the quiescent water level 'Q' in the pool 2 and therefore not being visible to users of the pool or taking up any valuable space around the poolside. One or more flow paths 6''' feed from the vessel 4'' to the pool inlet via associated control valves 10.

As with the embodiment of FIG. 2, the upper regions of the vessel 4'' are supplied from a source of compressed air 'S' whereby the volume of water 'D' in the vessel is held under pressure. One or more feed lines 14 extend from the pool side to points in the flow path 6''' downstream of the associated valves 10.

Concurrently with opening of the valves 10, air is drawn into the feed lines 14 to be entrained with said water flowing from the vessel 4'' whereby the above-detailed turbulent waves are formed in the pool 2.

The height, number and frequency of the waves can again be varied by appropriate control of the valves 10 and the pressure of the compressed air 'P'.

The pressure vessel 4'' refills directly from the pool under gravity.

Thus there is provided apparatus for forming a variety of artificial waves in which the water volume to be fed to the pool to create the waves is stored in a reservoir remote from the pool and connected thereto by distinct flow paths or funnels, said flow paths being provided with air therein for entrainment with the water flowing therethrough to create turbulent waves in the pool.

The embodiments of FIGS. 1 and 2 have a significant advantage over many known arrangements in that the control valve or valves 10 are above the quiescent level of the water in the pool 2 and are therefore readily accessible for servicing and/or repair.

The embodiment of FIG. 3 has the advantage of compactness whilst still producing waves in the same manner as the apparatus of FIGS. 1 and 2.

What we claim and desire to secure by Letters Patent is:

1. Apparatus for generating waves in a swimming pool having a quiescent water level therein, the apparatus comprising a reservoir independent of and separate from the pool, a volume of water within the reservoir, at least one inlet communicating into the lower regions of the swimming pool and adapted to be supplied with water from said volume within the reservoir, at least one flow path for each inlet, through which water from the reservoir is fed to the associated inlet, a flow control valve in each flow path, and, defined within each flow path downstream of the associated control valve, a volume of air for entrainment with the water flowing to the swimming pool such that, on entry of the water into the swimming pool, a wave having a turbulent, air-containing wake is formed.

2. Apparatus as claimed in claim 1 in which each control valve is a pneumatically-operated drum valve.

3. Apparatus as claimed in claim 1 in which the bottom of the reservoir is located substantially above the quiescent water level in the swimming pool, water in the reservoir flowing under gravity from the reservoir into the swimming pool, the volume of air in each flow path being contained therein immediately downstream of the associated control valve.

4. Apparatus as claimed in claim 1 in which the reservoir is located above but substantially adjacent the quiescent level of water in the swimming pool, the apparatus further comprising a source of compressed gas applied to the surface of the volume of water within the reservoir and adapted to force water from the reservoir into the swimming pool in a controlled manner, each flow path defining therein a volume of air immediately downstream of the associated control valve.

5. Apparatus as claimed in claim 1 in which the reservoir is located below the quiescent level of water in the swimming pool, the apparatus further comprising a source of compressed gas applied to the surface of the volume of water within the reservoir and adapted to force water from the reservoir into the swimming pool in a controlled manner, and means for introducing air into each flow path downstream of the associated control valve.

6. Apparatus as claimed in claim 5 and comprising a vent line extending from each flow path at a point downstream of the associated control valve to a point above the quiescent level of water in the swimming pool whereby air is drawn into each flow path as water flows therethrough.

* * * * *